US005275506A

United States Patent [19]

Grimsley

[11] Patent Number: 5,275,506

[45] Date of Patent: Jan. 4, 1994

[54] PERFORATED DRAINPIPE FOR RAILWAY DECKS

[75] Inventor: William Grimsley, Covina, Calif.

[73] Assignee: Herzog Contracting Corp., St. Joseph, Mo.

[21] Appl. No.: 2,185

[22] Filed: Jan. 8, 1993

[51] Int. Cl.[5] ..... E02B 11/00

[52] U.S. Cl. ..... 405/43; 405/36

[58] Field of Search ..... 405/36, 38, 43, 46, 405/47, 48, 49; 238/2

[56] References Cited

U.S. PATENT DOCUMENTS

| | | | |
|---|---|---|---|
| 2,126,091 | 8/1938 | Claybaugh | 405/124 |
| 3,440,823 | 4/1969 | Olsen . | |
| 4,020,639 | 5/1977 | Nagare et al. . | |
| 4,232,823 | 11/1980 | Eggermann | 405/38 X |
| 4,245,924 | 1/1981 | Fouss et al. . | |
| 4,523,613 | 6/1985 | Fouss et al. . | |
| 4,538,141 | 8/1985 | Feldman . | |
| 4,598,277 | 7/1986 | Feldman . | |

*Primary Examiner*—David H. Corbin

*Attorney, Agent, or Firm*—Litman, McMahon & Brown

[57] ABSTRACT

An improved railway deck drainage system includes an electrically non-conducting material formed into a plurality of hemiarcuate drain sections, each having a conduit and a coupling flange. The coupling flange of each section is matingly engaged with the conduit of the adjacent section, and the conduit is integrally coupled with a planar base to form a drain of overall hemicylindrical shape. The base of the drain extends transversely to form a pair of flanges suitable for weighting with ballast. A mounting strap couples the drain to the railway deck. Preferably, the conduit includes apertures to permit passage of water into the drain.

3 Claims, 1 Drawing Sheet

PERFORATED DRAINPIPE FOR RAILWAY DECKS

BACKGROUND OF THE INVENTION

1. Field of the Invention

The present invention relates generally to an electrically non-conducting drainage system for use on a railway deck. More particularly, it is concerned with a system of flanged conduits, intercoupled to form a series of strong joints. The conduits in turn are integrally coupled with a wide, planar base which reduces collection of sediment. Advantageously, the resulting simple, relatively low cost drainage system may be constructed from commercially available components.

2. Description of the Related Art

Prior art railway deck drainage systems employ sections of perforated galvanized metal pipe. Such previous deck drains conduct electricity and are not suited for use on electric commuter railway lines without installation of a stray current protection device. Such devices are costly, complicated, and subject to failure. Moreover, despite galvanizing, which adds to the cost of the system, both the drain pipe and the stray current protection device are subject to some corrosion and must be replaced periodically. Perforation of metal pipe is also costly. In addition, the pipe sections of such systems are generally installed in abutting relationship, resulting in a lack of structural strength at the joints. Because of the size of the pipe required to construct an effective drain, the pipes are heavy and cumbersome to install.

SUMMARY OF THE INVENTION

The present invention overcomes the problems previously outlined and provides a greatly improved railway deck drainage system. Broadly speaking, the system includes an electrically non-conducting material formed into a plurality of drain sections, each having a conduit and a flange, the flange of each section being coupled in mating engagement with the conduit of the adjacent section. The conduit is integrally coupled with a planar base. A mounting strap couples the drain to the railway deck. Preferably, the conduit includes apertures to permit passage of water into the drain.

In particularly preferred forms the drain sections are of hemiarcuate cross section and are coupled to the base to form a drain of overall hemicylindrical shape, the base extending transversely to form a pair of flanges suitable for weighting with ballast.

OBJECTS AND ADVANTAGES OF THE INVENTION

The principal objects and advantages of the present invention include: providing a railway drainage system which does not conduct electricity and is suitable for use on electric rail lines such as commuter trains; providing a drainage system which may be constructed at relatively low cost from commercially available components which are easily coupled; providing a drainage system having improved structural strength at the seams; providing a drainage system which is not subject to corrosion; providing a drainage system having improved sediment collection characteristics; providing a non-electrically conducting conduit system which is suitable for carrying services. Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 1:
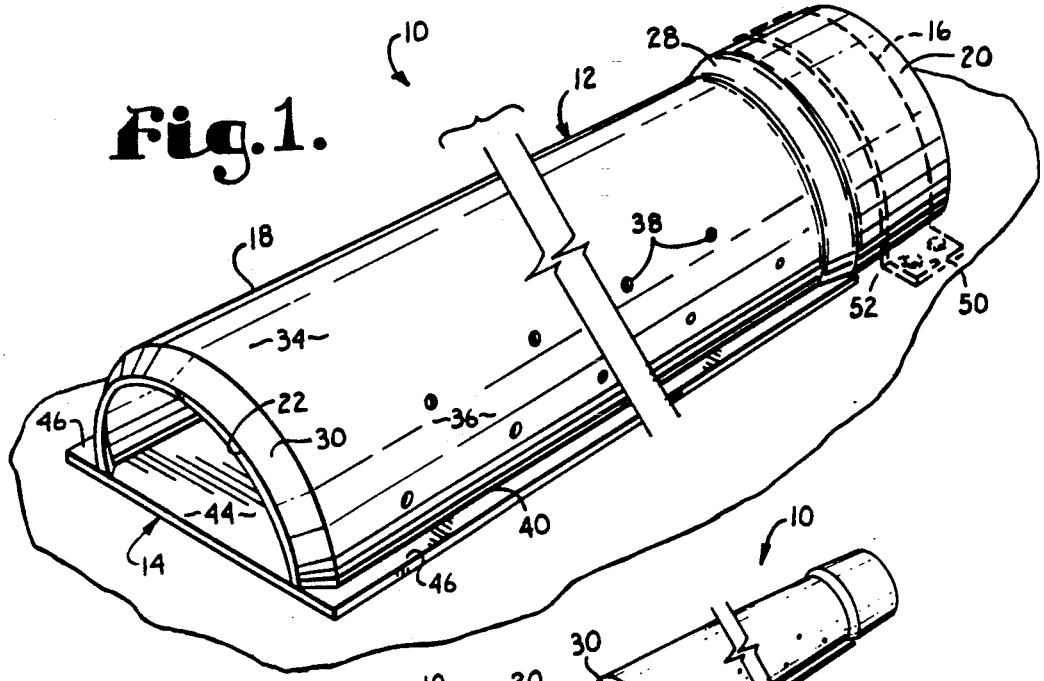
FIG. 1 is a perspective view of the perforated drain pipe in accordance with the present invention.
Figure 2:
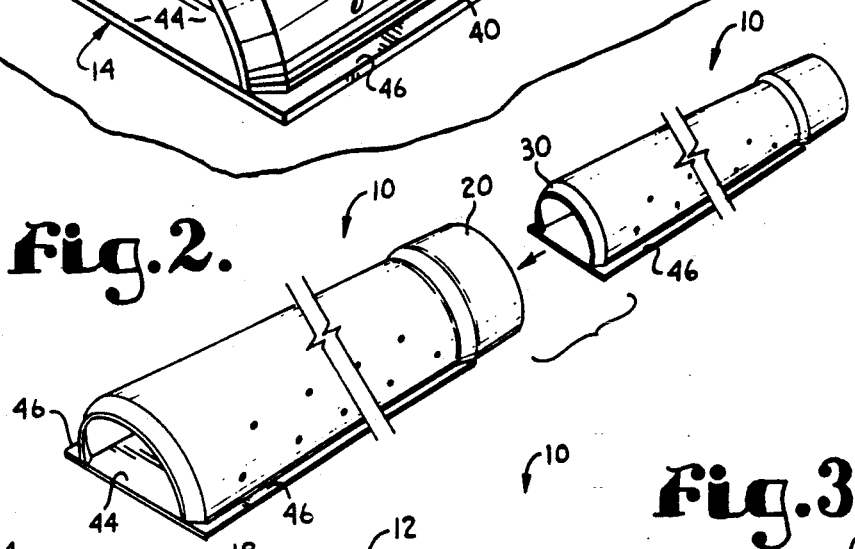
FIG. 2 is a reduced view of a pair of the pipes of FIG. 1 showing the manner of coupling.
Figure 3:
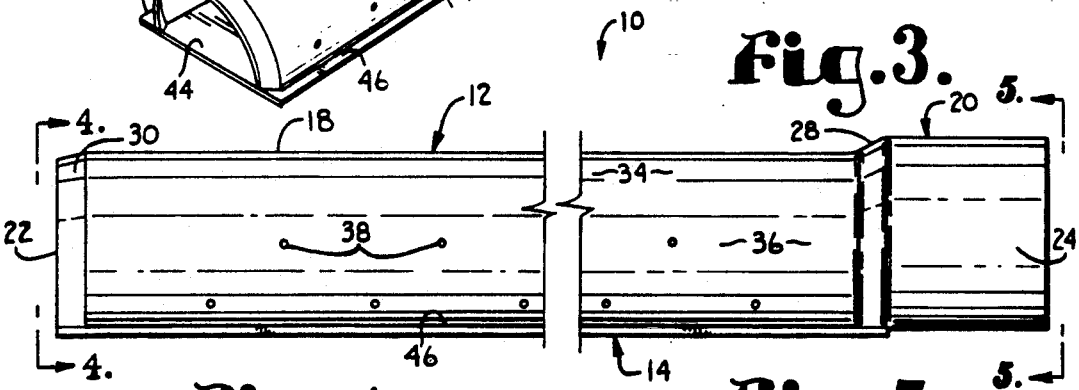
FIG. 3 is a side elevation view of the pipe of FIG. 1.
Figure 4:
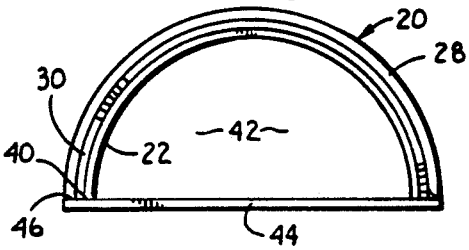
FIG. 4 is a frontal view taken along line 4–4 of FIG. 3.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Introduction and Environment

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring now to the drawing, a drainage device 10 for a railway deck 10 in accordance with the invention broadly includes a pipe 12, a generally planar bottom plate 14, and a mounting strap 16.

Figure 5:
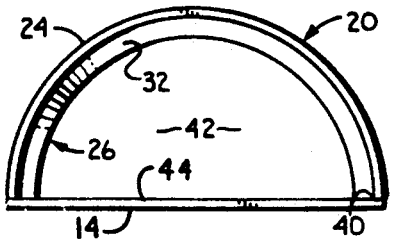
FIG. 5 is a rear view taken along line 5—5 of FIG. 3 showing the internal shoulder of the flange depicted in FIG. 3.

In more detail, pipe 12 is of integral construction and is preferably formed of electrically resistive synthetic resinous material into a tubular conduit portion 18 having an axially expanded coupling flange 20 at one end and a rim 22 at the opposed end. As best shown in FIGS. 1 and 5, flange 20 includes exterior and interior portions 24, 26, the exterior 24 being joined to tubular portion 18 by a bevel 28 to provide a smooth transition and prevent the pipe being hung up by flange 20 when it is moved along a surface in sliding fashion. Conduit 18 includes a similarly bevelled portion 30 adjacent rim 22 for ease of coupling with the flange 20 of an adjacent pipe. Flange interior 26 includes an incurvate shoulder 32, which serves as a stop when two pipes are intercoupled.

Conduit 18 is of substantially hemiarcuate cross section and includes an upper crown portion 34 and a lower sidewall portion 36 having spaced apertures 38 to permit entry of water into the conduit. Apertures 38 are preferably disposed in a random or staggered arrangement to permit thorough drainage of the surrounding railway deck area without formation of dead spots or pools. In embodiments adapted for carrying of services such as electrical wires and not for drainage, apertures 38 would be absent to protect the wires from water.

Bottom margin 40 is integrally coupled with bottom plate 14 to form a hollow channel 42 to permit passage of water, or carrying of electrical or telephone wiring, fiberoptic cables, piping or other services. Such coupling is preferably by fusion welding or any other method yielding a seam having substantial structural strength.

Bottom plate 14 is of generally smooth, planar construction having a width exceeding the diameter of conduit 18 so that bottom margin 40 divides plate 14 into a center portion 44, and a pair of transversely extending flanges 46. In especially preferred forms, bottom plate 14 extends to form flanges 46 measuring at least about ½" in width. The wide smooth center portion 44 serves to reduce sediment collection in the pipe 12, while the flanges 46 can be weighted with ballast to anchor the system.

Mounting strap 16 includes a generally curved bight portion 48 and a pair of opposed flanges 50 which are apertured to accommodate a pair of bolts or spikes 52. The strap may be constructed of metal, synthetic resinous or any suitable material.

Advantageously, device 10 is constructed of commercially available synthetic resin pipe such as polyvinyl chloride or acrylonitrile-butadiene styrene which is not subject to corrosion and which may have the property of high electrical resistivity. While virtually any size piping may be employed, schedule 80 is preferred for use in railway deck applications. In accordance with the preferred embodiment, split pipe having a hemiarcuate cross section is coupled to the base to form a generally hemicylindrically shaped drain. Those skilled in the art will appreciate that other configurations such as circular pipe fusion welded to a planar base, or generally triangular split pipe fusion welded to a planar base might also be employed.

Adjacent similar pipe sections 12 are easily intercoupled to form a drain 10 having a series of stable overlapping joints which can withstand thermal expansion and contraction and vibrational movements. The drainage device 10 is installed by pushing the rim end of a first pipe 12 toward the flange end of a similar second pipe so that the base flanges 46 of the first pipe slide beneath flange exterior 24 of the second pipe, and conduit 18 is matingly engaged with flange interior 26. The pipes are pushed together until the bevel 30 of the first pipe contacts the shoulder 32 of the second pipe.

The bight portion 48 of mounting strap 16 is installed over coupling flange 20 so that strap flanges 50 are adjacent the deck. Bolts or spikes may then be installed. In preferred embodiments, ballast is infilled between adjacent drains 10 and serves to weight them against the deck. In certain embodiments ballast alone may be sufficient to install the drains without mounting straps 16. In other embodiments, depending on the length of pipes 12, straps 16 may be installed at distant spaced intervals and not at every flange 20.

In operation, water flows inwardly from the surface of the railway deck and, in certain instances, filters through adjacent ballast through apertures 38, and into channel 42. Any sediment is pushed along the wide center portion 44 of bottom plate 14 by the flow of the water.

It is to be understood that while certain forms of the present invention have been illustrated and described herein, it is not to be limited to the specific forms or arrangement of parts described and shown.

Having described the preferred embodiments of the present invention, the following is claimed as new and desired to be secured by Letters Patent:

1. A drainage device for a railway deck, comprising:

(a) an electrically non-conducting material formed into a plurality of drain sections, each including a perforated conduit portion with a bevelled, male end and a flange portion with a female end for telescopically receiving and coupling with a respective male end of an adjacent drain section conduit portion;

(b) each said conduit portion including a pair of lower edges extending in substantially parallel relationship from a respective flange portion to a respective male end;

(c) each said drain section having a substantially hemiarcuate cross-section;

(d) each said flange portion being axially expanded from an adjacent conduit portion for receiving a respective conduit portion beveled end;

(e) each said drain section including an elongate planar base portion with a first end located adjacent to a respective conduit portion male end and a second end located in spaced relation inwardly from a respective conduit portion female end, each said conduit portion at its lower edges being integrally coupled with a respective base portion;

(f) each said base portion including a pair of opposed, longitudinal flanges protruding transversely outwardly from said conduit portion lower edges;

(g) a plurality of mounting straps for mounting drain sections on said railway deck, each said mounting strap comprising an arcuate portion receiving a respective drain flange portion and a pair of opposite end extensions each adapted for engaging the railway deck on opposite sides of a respective drain section; and (h) a pair of mechanical fasteners each extending through a respective end extension and adapted for extending into said railway deck for mounting said device thereon.

2. The apparatus as set forth in claim 1, wherein said integral coupling is by fusion welding.

3. The apparatus as set forth in claim 1, wherein said electrically non-conducting material is a synthetic resin.

* * * * *